US012207773B2

(12) United States Patent
Schimmel

(10) Patent No.: US 12,207,773 B2
(45) Date of Patent: Jan. 28, 2025

(54) SYSTEM FOR AUTOMATICALLY CLEANING A SURFACE OF A FLOOR AND A FLOOR PROVIDED WITH SUCH A SYSTEM

(71) Applicant: Urilift Beheer B.V., Beemte-Broekland (NL)

(72) Inventor: Marten Alberto Schimmel, Beemte-Broekland (NL)

(73) Assignee: Urilift Beheer B.V., Beemte-Broekland (NL)

( * ) Notice: Subject to any disclaimer, the term of this patent is extended or adjusted under 35 U.S.C. 154(b) by 28 days.

(21) Appl. No.: 18/246,187

(22) PCT Filed: Sep. 21, 2021

(86) PCT No.: PCT/NL2021/050564

§ 371 (c)(1),
(2) Date: Mar. 23, 2023

(87) PCT Pub. No.: WO2022/071794

PCT Pub. Date: Apr. 7, 2022

(65) Prior Publication Data

US 2023/0404348 A1 Dec. 21, 2023

(30) Foreign Application Priority Data

Oct. 1, 2020 (NL) ..... 2026605

(51) Int. Cl.
*A47L 11/12* (2006.01)
*A47L 11/284* (2006.01)

(52) U.S. Cl.
CPC ..... *A47L 11/125* (2013.01); *A47L 11/284* (2013.01)

(58) Field of Classification Search
CPC ..... A47L 11/12; A47L 11/125; A47L 11/284; B08B 3/024
See application file for complete search history.

(56) References Cited

U.S. PATENT DOCUMENTS 8,819,892 B1 9/2014 Mangum
2018/0016778 A1 1/2018 Arnott

FOREIGN PATENT DOCUMENTS

CN 107204157 A * 9/2017 ..... B05B 12/085
DE 102006004508 A1 8/2007
(Continued)

OTHER PUBLICATIONS

CN 211207867 U; Aug. 7, 2020; Gao et al.*
(Continued)

*Primary Examiner* — Randall E Chin
(74) *Attorney, Agent, or Firm* — Oppedahl Patent Law Firm LLC

(57) ABSTRACT

The invention relates to a system (1) for automatically cleaning a surface of a floor, comprising a cleaning element (10). The system is arranged for moving the cleaning element relative to the floor between a rest position and a position of use, in which the cleaning element is moveable across the floor surface. The cleaning element (10) is received in the floor in the rest position. The system (1) further comprises a guiding element (20) on which the cleaning element (10) is movable. Adjacent to the guiding element (20) floorplates (100) are arranged such that gutters (102) are defined between the floorplates (100) and the guiding element (20) The invention also relates to a floor provided with the system (10) according to the invention.

8 Claims, 6 Drawing Sheets

(56) References Cited

FOREIGN PATENT DOCUMENTS

| | | | |
|---|---|---|---|
| GB | 2549192 | A | 10/2017 |
| IT | M20051873 | A1 | 4/2007 |
| JP | H01-287328 | A | 11/1989 |

OTHER PUBLICATIONS

International Search Report in PCT/NL2021/050564, mailing date Mar. 29, 2022.
Dutch Search Report and Written Opinion in Dutch application No. 2026605, dated Feb. 8, 2021.

* cited by examiner

SYSTEM FOR AUTOMATICALLY CLEANING A SURFACE OF A FLOOR AND A FLOOR PROVIDED WITH SUCH A SYSTEM

The invention relates to a system for automatically cleaning a surface of a floor, comprising a cleaning element, wherein the system is arranged for moving the cleaning element relative to the floor between a rest position and a position of use, wherein the cleaning element is moveable across the floor surface.

Such a system is known from the Italian patent application M12005A001873, in which a cleaning device is described for a floor of a public sanitary facility having such a cleaning element that is moveable on a rail across the floor. The cleaning element is received into a wall of the public sanitary facility in rest position. The known cleaning device has the disadvantage that in the wall, in which the cleaning element is received, no longer a door can be placed, which forms a limitation for the further interior layout of the space.

The present invention has for its object to provide a universal solution for the automatic cleaning of a floor, in particular a floor in a public sanitary facility.

To that end, the present invention provides a system according to the preamble of claim 1, characterized in that, the cleaning element is received in the floor in the rest position.

The system according to the invention distinguishes itself from the prior art because the cleaning element is integrated in the floor and is a part of it. Consequently, the invention provides a universal system for automatically cleaning a floor surface that can be placed in every floor.

It is customary that in a public sanitary facility a technical room is located behind one of the walls. When putting the system according to the invention to use, another door can be placed in each of the other walls of the public sanitary facility, allowing an optimal layout of multiple public sanitary facilities in an available space.

According to a first preferred embodiment the system comprises a guiding element with a first running surface for the cleaning element. The system with guiding element is intended to be received in the floor, whereby the first running surface is a part of the floor surface. In a practical preferred embodiment, the guiding element comprises a second running surface which is partially inclined. In a subsequent practical preferred embodiment, the cleaning element is hingedly attached to the guiding element.

In a compact preferred embodiment, the system comprises a drive for moving the cleaning element, which drive is received in the guiding element.

In a subsequent preferred embodiment, the cleaning element is provided with a series of nozzles for spraying a fluid onto the surface of the floor and the system is further provided with one or more flexible fluid conduits, which are connectable to the cleaning element for supply of the fluid to the nozzles. According to a compact preferred embodiment the fluid conduits are received in the guiding element.

According to a further elaboration of the subsequent preferred embodiment, the guiding element is provided with revolution wheels for the fluid conduits, wherein the revolution wheels are attached moveably to the guiding element and wherein the revolution wheels are freely rotatable in the position of use. The revolution wheels protect the fluid conduits from damage during movement of the cleaning element.

To allow for optimal cleaning, the cleaning element in the system according to the invention, is provided with one or more brushes.

In a different preferred embodiment, the cleaning element has a generally elongated shape with a longitudinal direction, which longitudinal direction extends substantially transversely to the direction of movement of the cleaning element in the position of use. Preferably, the dimensions of the elongated cleaning element are chosen as such that the cleaning element covers the entire floor surface during a reciprocating movement.

Preferably, the cleaning element comprises a housing with a top side, which top side is substantially lying flush with the running surface in the rest position. When receiving the system into the floor, the top side of the housing then also forms a part of the floor surface.

According to a very complete preferred embodiment the system further comprises a number of floorplates, which are intended to be placed adjacent to the guiding element. The floorplates, together with the guiding element, form a complete floor.

The present invention also relates to a floor provided with a system according to the invention.

The invention will now be described in more detail with reference to the figures, wherein FIG. 1A shows a schematic view of the system according to the invention with the cleaning element in rest position;

FIG. 1B shows part A of FIG. 1A in more detail;

FIG. 2A schematically shows the system of FIG. 1A in bottom view;

Figure 1A:
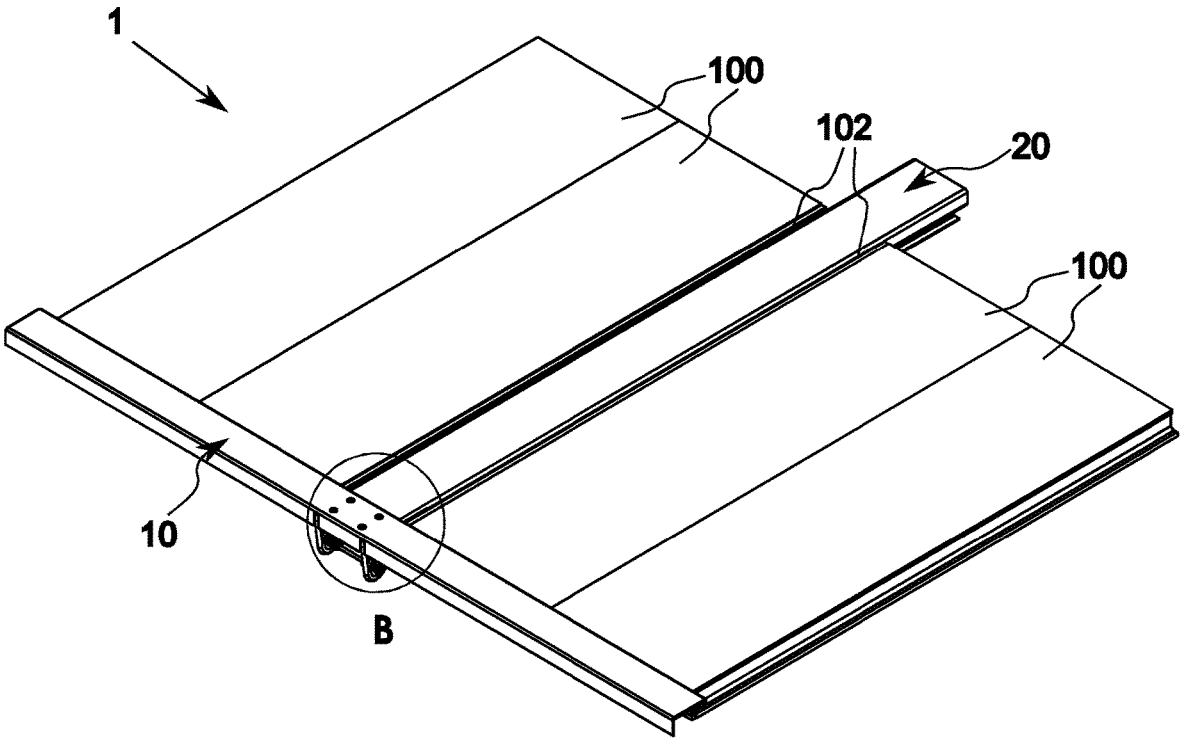
Figure 1B:
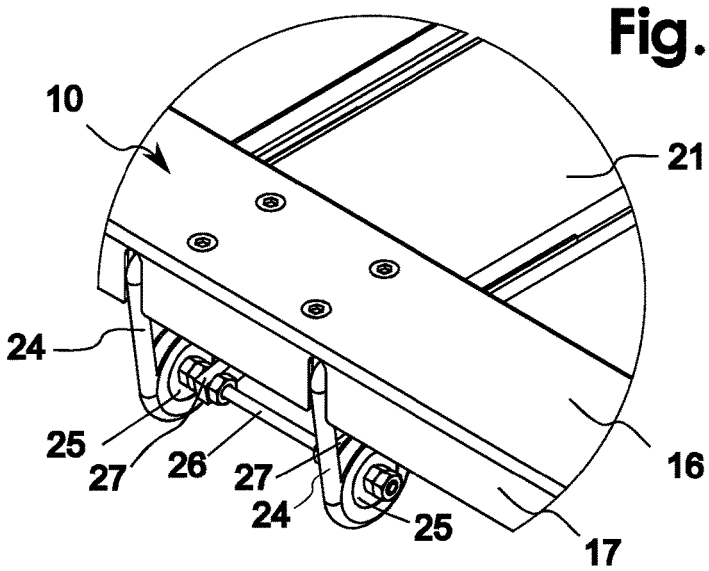

FIG. 1A shows a schematic view of a preferred embodiment of the system 1 according to the invention. The system 1 comprises a cleaning element 10, that is shown in a rest position in FIGS. 1A and 1B. The system 1 further comprises a guiding element 20 on which the cleaning element 10 is moveable. Adjacent to the guiding element 20 floorplates 100 have been placed, such that gutters 102 are defined between the floorplates 100 and the guiding element 20.

Figure 2A:
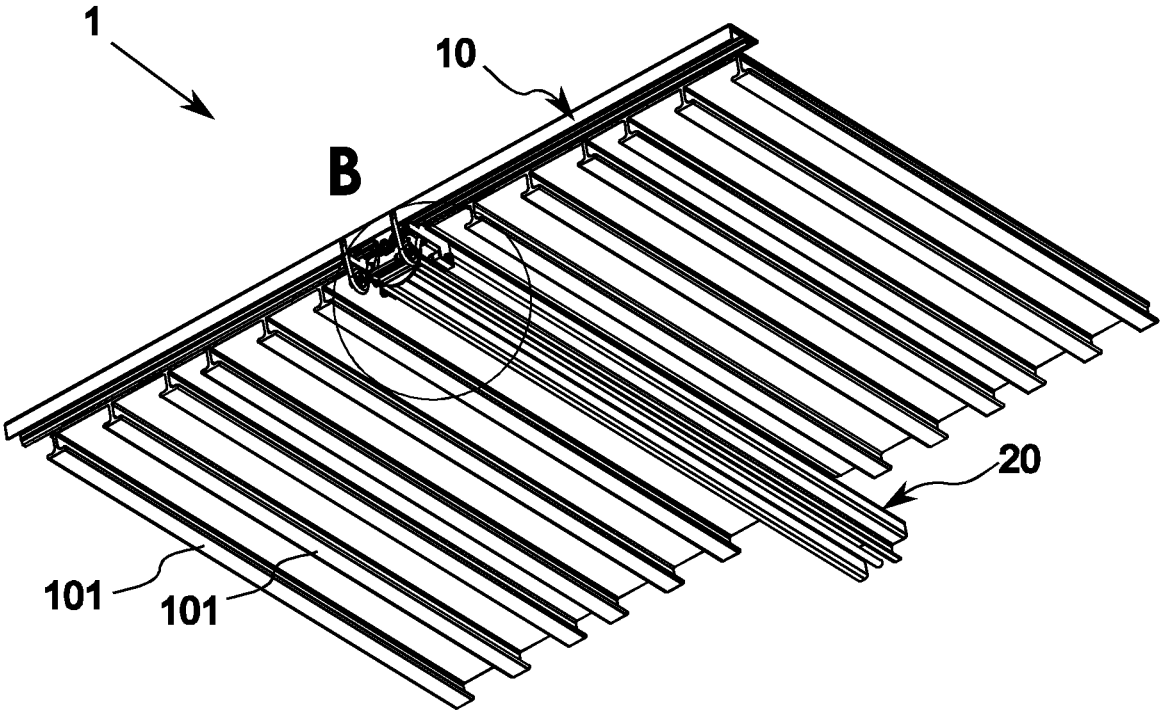
FIG. 2B shows part B of FIG. 2A in more detail.

FIG. 2A schematically shows the system 1 in the rest position in bottom view.

The cleaning element 10 is intended for cleaning the surface of a floor, in this example the surface of the floorplates 100 and that of the guiding element 20. In the shown preferred embodiment, the floorplates 100 rest on supports 101, such that the floor surface is substantially flat. In the rest position the cleaning element 10 is integrated in the floor. In the shown preferred embodiment this has been realized by the cleaning element having a housing 16 with a top side, which in the rest position is lying substantially flush with the floor surface.

Figure 2B:
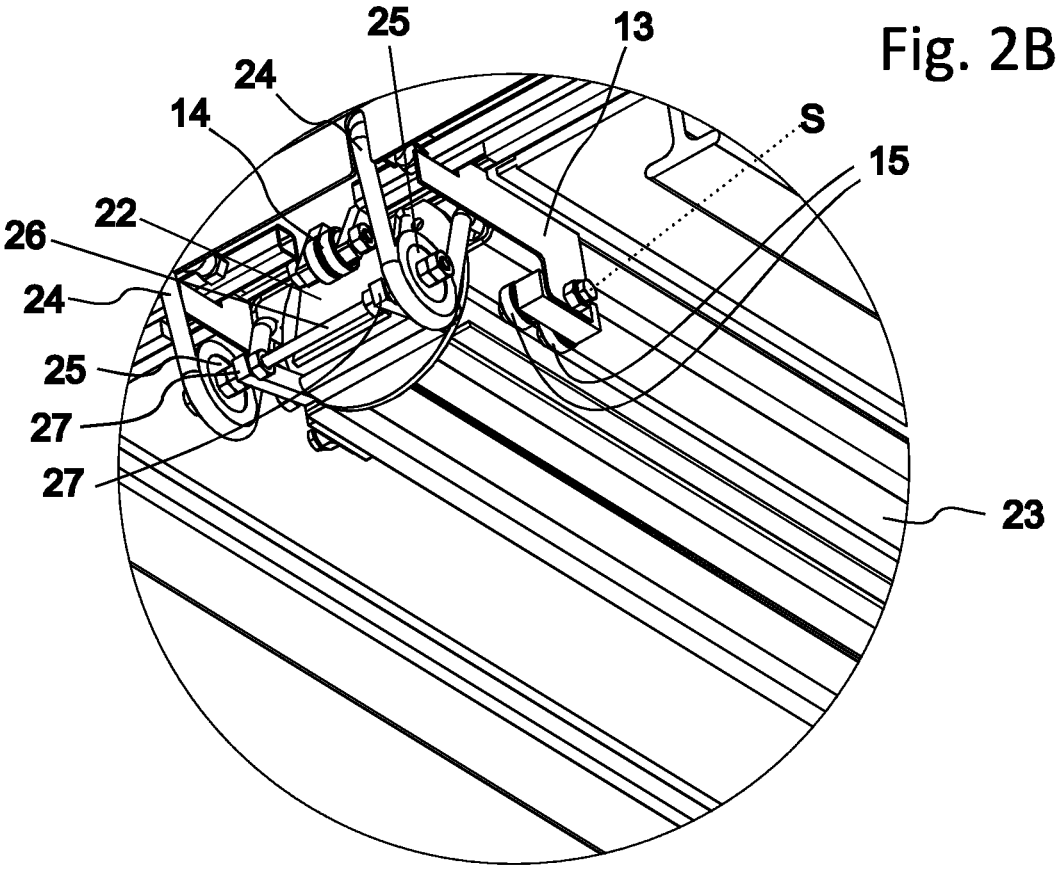

FIG. 2B shows a part B of FIG. 2A in more detail.

The cleaning element 10 is hingedly attached to the guiding element 20. In the shown preferred embodiment, the cleaning element 10 is attached to hinge plates 13, which are attached hingedly about axis S on guiding wheels 15. The guiding wheels 15 are moveable on rails 23, which extend on both sides along the guiding element 20. In the rest position of the cleaning element 10 the hinge plates 13 preferably lie below the floor surface. In the maintenance position and the position of use of the cleaning element 10 the hinge plates 13 protrude the floor surface through the gutters 102.

The guiding element 20 is provided with a first running surface 21 and a second running surface 22 for the cleaning element 10. The first running surface 21 is substantially level and is formed by the top side of the guiding element 10. The second running surface 22 connects to the first running surface 21 and is inclined. In the shown preferred embodiment, the cleaning element 10 is provided with bearings 14, which are moveable on the running surfaces 21, 22.

In the shown preferred embodiment, the cleaning element 10 is provided with a series of nozzles 11 (shown in FIG. 3B) for spraying a fluid onto the surface of the floor 100. To that end, the system 1 is further provided with one or more flexible fluid conduits 24, which are connectable to junctions 15 (shown in FIG. 3C) on the cleaning element 10 for supplying the fluid to the nozzles 11. The housing is provided with a cover plate 17 with slots 18 therein for the passage of the fluid conduits 24. In the shown preferred embodiment, the fluid conduits 24 are received in the guiding element 20. The guiding element 20 is provided with revolution wheels 25 for the fluid conduits 24. The revolution wheels 25 are arranged on a shaft 26, which is connected to the guiding element 20 by hinged arms 27. The system of the hinged arms 27 with the revolution wheels 25 and shaft 26 is likewise moveable between a rest position and a position of use. In the position of use, the revolution wheels 25 with fluid conduits 24 are free from the ground on which the guiding element 20 is resting to prevent damaging of the fluid conduits 24 during movement of the cleaning element 10.

A drive is included in the guiding element 20 (not shown) for moving the cleaning element 10 on the guiding element 20. Examples of a suitable drive are a spindle or a linear drive.

Figure 3A:
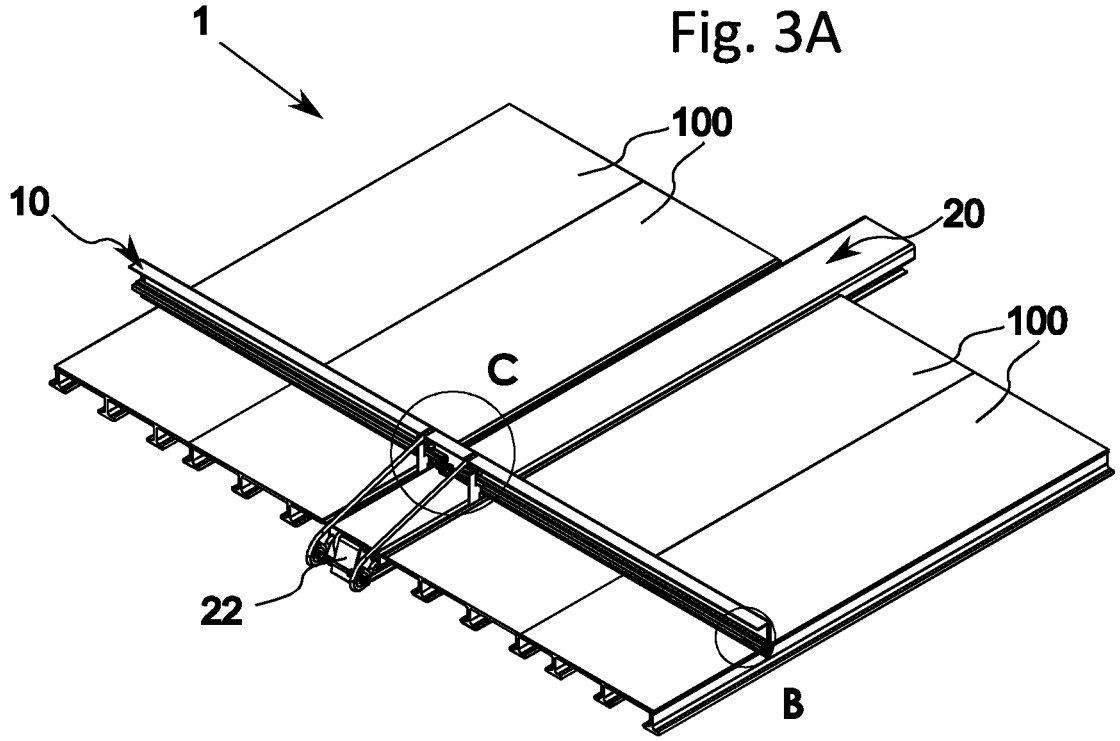
FIG. 3A shows a schematic view of the system according to the invention with the cleaning element in a maintenance position.
Figure 3B:
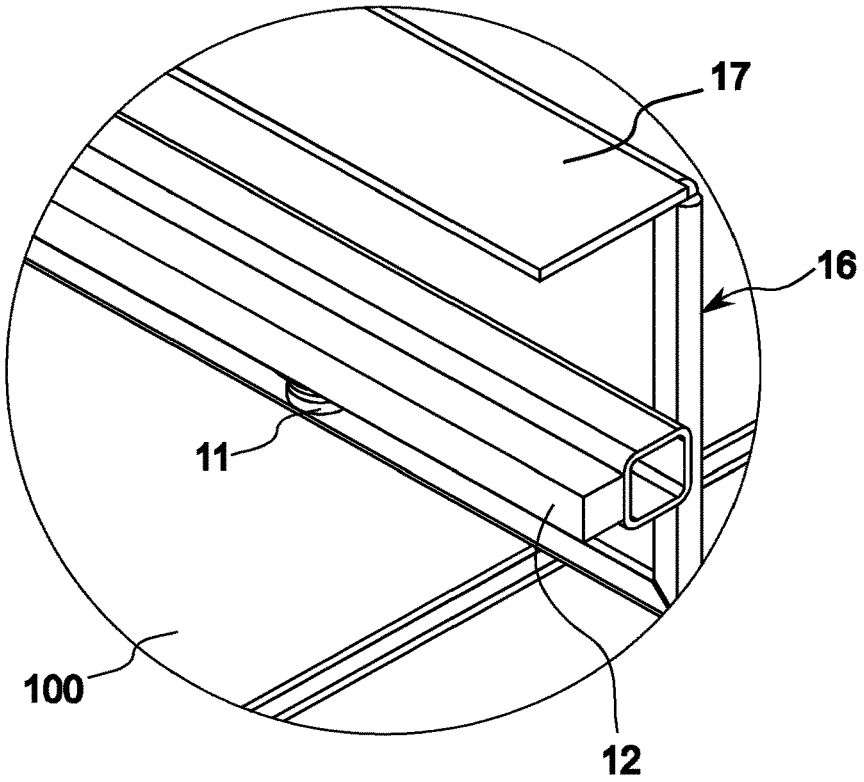
FIG. 3B shows part B of FIG. 3A in more detail.
Figure 3C:
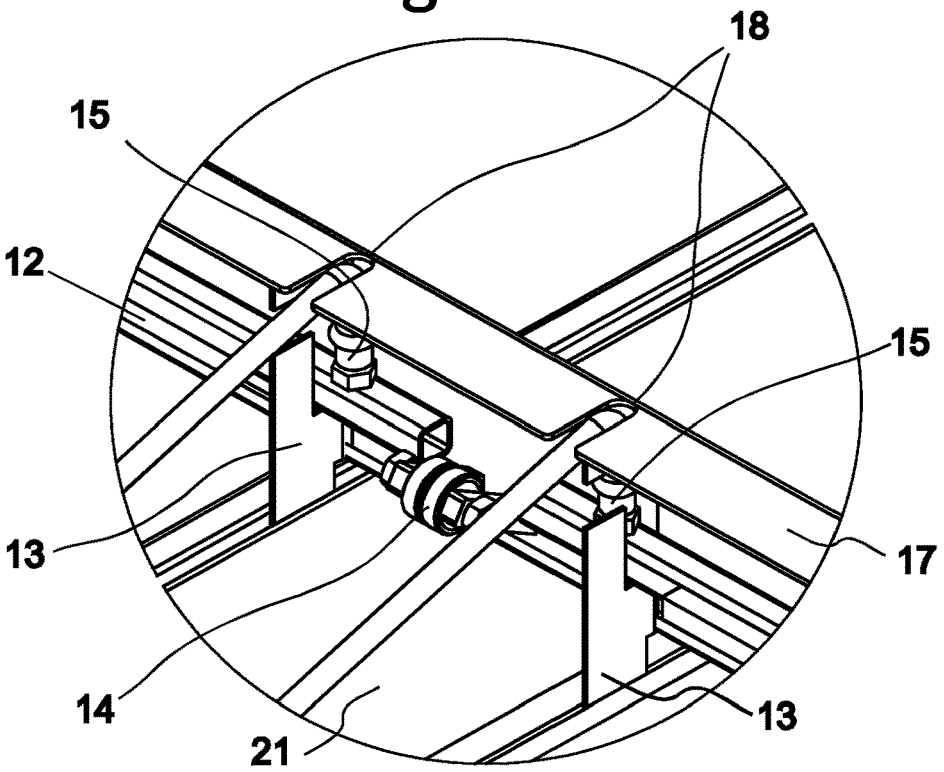
FIG. 3C shows part C of FIG. 3A in more detail.

FIG. 3A shows the system 1 with the cleaning element 10 in a maintenance position, in which the housing 16 is folded open. FIG. 3B and FIG. 3C show parts of FIG. 3A in more detail. In here, a nozzle 11 is shown as an example. The number of nozzles is variable and can be adjusted to the environment in which the system according to the invention is to be put to use.

In the shown preferred embodiment, the cleaning element is also provided with one or more brushes 12.

FIGS. 4A through 4D show the system 1 with the cleaning element 10 in various positions in the position of use.

Figure 4A:
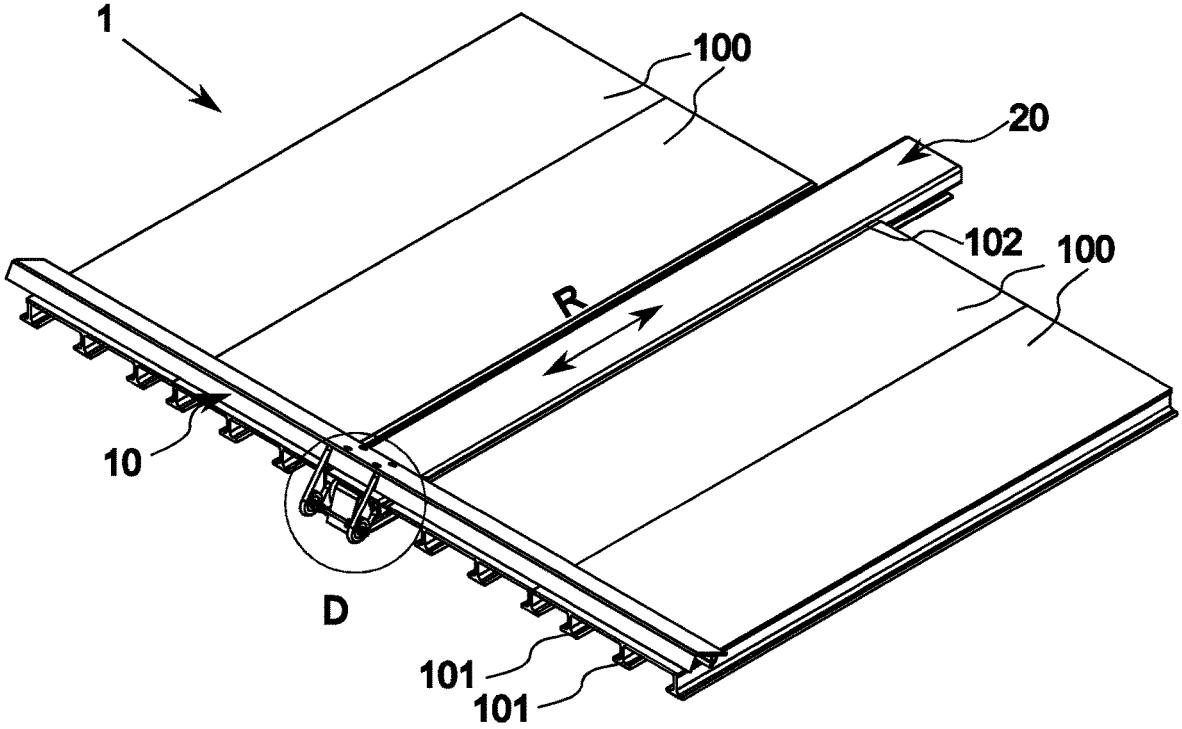
FIG. 4A shows a schematic view of the system according to the invention with the cleaning element in a first position of use.
Figure 4B:
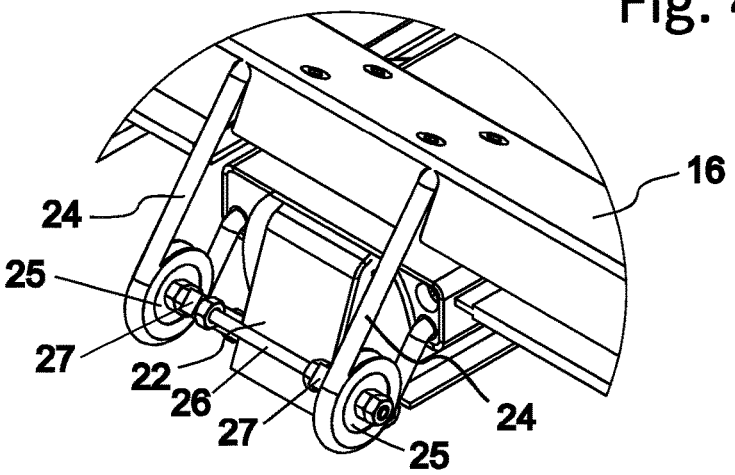
FIG. 4B shows part D of FIG. 4A in more detail.

The first position, shown in FIGS. 4A and 4B, is a starting position of a cleaning cycle. Starting from the rest position, the bearings 14 have moved to the first running surface 21 via the second running surface 22. The hinge plates 13 are thereby moved. The housing 16 is therefore tilted and the revolution wheels 25 are freely rotatable.

From this first position, the cleaning element 10 is moveable across the floor surface to a second and third position and back to the rest position. In the shown preferred embodiment, the direction of movement R runs substantially parallel to gutters 102.

Figure 4C:
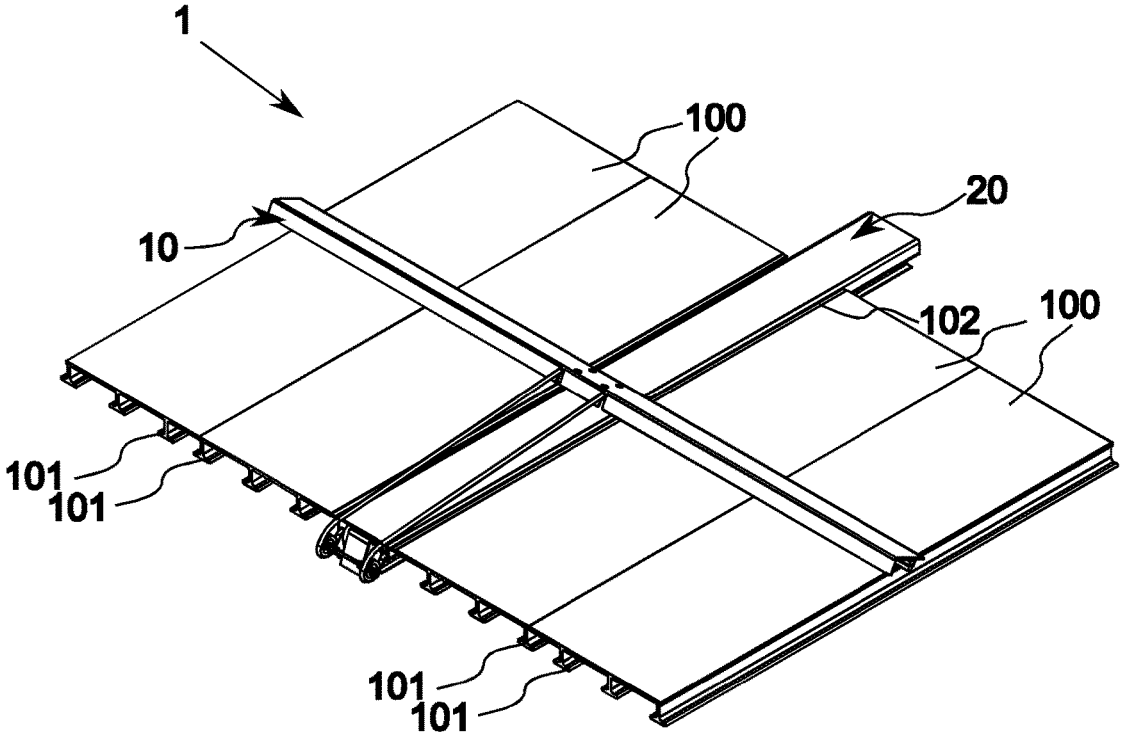
FIG. 4C shows a schematic view of the system according to the invention with the cleaning element in a second position of use.

In the second position, shown in FIG. 4C, the cleaning element 10 on the floor takes in a middle position in the cleaning cycle, both during the forward and the backward movement R.

Figure 4D:
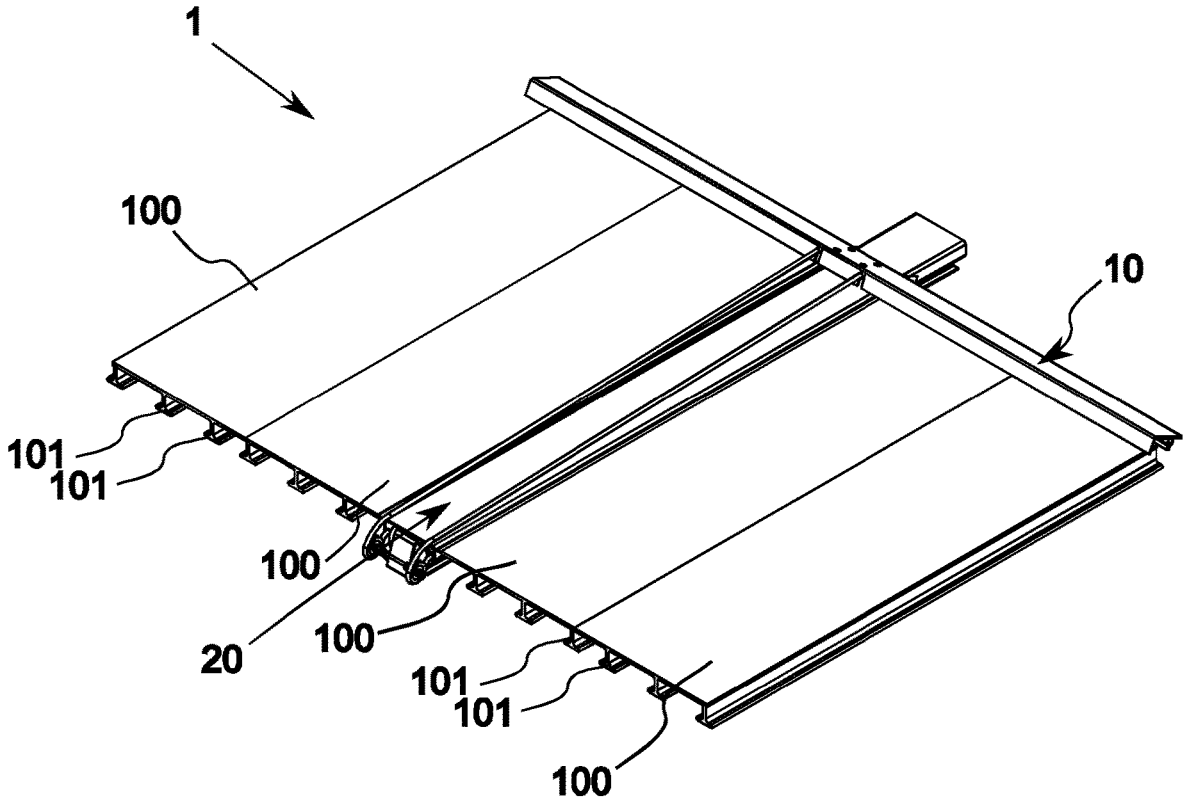
FIG. 4D shows a schematic view of the system according to the invention with the cleaning element in a third position of use.

The third position, shown in FIG. 4D is an end position of the cleaning cycle, in which the cleaning element 10 is located at the end of the floor surface. From the third position the cleaning element 10 moves, via the second and the first position, back from the position of use to the rest position.

In the shown preferred embodiment of the system 1 according to the invention, the cleaning element has a generally elongated shape with a longitudinal direction, which longitudinal direction extends substantially transversely to the direction R of movement of the cleaning element 10 in the position of use.

Various materials are suitable for the system according to the invention, among which metal (in particular stainless steel) and plastic.

The invention is based on the idea of providing a system for a self-cleaning floor that can be completely integrated into a floor.

It is noted that the invention is explicitly not limited to the described and shown preferred embodiment. The choice for a guiding element is for example not necessary. One guiding element can also be replaced by multiple guiding elements. The central position of the guiding element is neither necessary. One or more guiding elements can be arranged out of the centre of the cleaning element and/or the floor. The drive can be placed outside of the guiding element, for example in a part of the floor. This also applies to the fluid conduits. These are just a few alternative embodiments that are within the reach of one skilled in the art.

The invention therefore extends to any embodiment falling within the scope of protection as defined in the claims and seen in the light of the foregoing description and accompanying drawings.

The invention claimed is:

1. A floor having a floor surface and provided with a system for automatically cleaning the floor surface, wherein the system comprises a cleaning element and a drive for moving the cleaning element relative to the floor between a rest position and a position of use, in which the cleaning element is moveable across the floor surface, wherein the cleaning element is received in the floor in the rest position, wherein the system comprises a guiding element with a first running surface for the cleaning element and a second running surface for the cleaning element, which first running surface is part of the floor surface and which second running surface connects to the first running surface and is inclined upwards towards the first running surface, wherein the cleaning element has a housing with a top side which in the rest position covers the second running surface and is substantially lying flush with the floor surface.

2. The floor according to claim 1, wherein the cleaning element is hingedly attached to the guiding element.

3. The floor according to claim 1, wherein the drive for moving the cleaning element is received in the guiding element.

4. The floor according to claim 1, wherein the cleaning element is provided with at least one nozzle for spraying a fluid onto the floor surface, and wherein the system is further provided with one or more flexible fluid conduits, which can be connected to the cleaning element for the supply of the fluid to the at least one nozzle, wherein the one or more fluid conduits are received in the guiding element.

5. The floor according to claim 4, wherein the guiding element is provided with revolution wheels for the one or more fluid conduits, wherein the revolution wheels are moveably attached to the guiding element, and wherein the revolution wheels are freely rotatable in the position of use.

6. The floor according to claim 1, wherein the cleaning element is provided with one or more brushes.

7. The floor according to claim 1, wherein the cleaning element has a generally elongated shape with a longitudinal direction, which longitudinal direction extends substantially transversely to a direction of movement of the cleaning element in the position of use.

8. The floor according to claim 1, wherein the floor further comprises a number of floorplates, which are intended to be placed adjacent to the guiding element.

* * * * *